US011142396B2

(12) United States Patent
Sofy et al.

(10) Patent No.: US 11,142,396 B2
(45) Date of Patent: Oct. 12, 2021

(54) CONTAINER WITH DIVERTER BAR

(71) Applicant: HMS Mfg. Co., Troy, MI (US)

(72) Inventors: Janet M. Sofy, Troy, MI (US); Michael E. Brown, Davison, MI (US); Todd M. Lajewski, Lapeer, MI (US)

(73) Assignee: HMS Mfg. Co., Troy, MI (US)

( * ) Notice: Subject to any disclaimer, the term of this patent is extended or adjusted under 35 U.S.C. 154(b) by 293 days.

(21) Appl. No.: 16/360,996

(22) Filed: Mar. 21, 2019

(65) Prior Publication Data

US 2019/0329977 A1 Oct. 31, 2019

Related U.S. Application Data

(60) Provisional application No. 62/662,263, filed on Apr. 25, 2018.

(51) Int. Cl.

| | |
|---|---|
| ***B65D 25/16*** | (2006.01) |
| ***B65F 1/16*** | (2006.01) |
| ***B65F 1/06*** | (2006.01) |

(52) U.S. Cl.

CPC ..... *B65F 1/1615* (2013.01); *B65F 1/06* (2013.01); *B65F 2210/148* (2013.01); *B65F 2220/12* (2013.01)

(58) Field of Classification Search

CPC ..... B65F 1/06; B65F 1/067; B65F 1/1615; B65F 2210/148; B65F 2220/12

USPC ..... 220/495.08, 735, 694

See application file for complete search history.

(56) References Cited

U.S. PATENT DOCUMENTS

| | | | |
|---|---|---|---|
| 2,960,254 | A | 11/1960 | Kiba |
| 4,576,310 | A | 3/1986 | Isgar et al. |
| 4,715,572 | A | 12/1987 | Robbins, III et al. |
| 4,785,964 | A | 11/1988 | Miller et al. |
| 4,953,740 | A | 9/1990 | Koda |
| 4,972,966 | A | 11/1990 | Craft, Jr. |
| 4,976,375 | A | 12/1990 | Quam |
| 5,190,183 | A | 3/1993 | McNaughton et al. |
| 5,265,755 | A | 11/1993 | McArthur, Jr. et al. |
| 6,024,240 | A | 2/2000 | Howard et al. |
| 6,099,097 | A | 8/2000 | Rocker et al. |
| 6,206,221 | B1 | 3/2001 | Bando et al. |
| 7,290,674 | B1 | 11/2007 | Ledford |

(Continued)

OTHER PUBLICATIONS

Bo Touch Bin, With 2 Inner Buckets, 11 + 23 Litre -31 White.
Paso Step Stool.

*Primary Examiner* — James N Smalley
*Assistant Examiner* — Elizabeth J Volz
(74) *Attorney, Agent, or Firm* — Dickinson Wright PLLC

(57) ABSTRACT

A container includes a base and a wall disposed about and attached to the base. The wall defines a rim spaced from the base, as well as a compartment extending between the base and the wall. A lid having an inner surface and an outer surface is coupled to the wall for covering the compartment. The container has a diverter bar for separating the compartment into at least two sections in a first position. The diverter bar has a body that extends between body ends, with the body releasably engaging the wall in the first position. A retainer attaches to the lid for receiving the diverter bar and securing the diverter bar to the lid to define a storage position. A lip extends outwardly from the body whereby the lip engages the retainer in response to the diverter bar being in the storage position.

12 Claims, 11 Drawing Sheets

(56) References Cited

U.S. PATENT DOCUMENTS

| | | | | |
|---|---|---|---|---|
| 8,028,854 | B2 | 10/2011 | Sofy et al. | |
| 8,042,704 | B2 | 10/2011 | Borowski et al. | |
| 8,418,874 | B2 | 4/2013 | Ahlgrim et al. | |
| 8,590,732 | B2 | 11/2013 | Vandamme et al. | |
| 9,238,548 | B2 | 1/2016 | Hooley et al. | |
| 9,365,332 | B2 * | 6/2016 | Jentis | G01F 19/002 |
| 9,434,538 | B2 | 9/2016 | Yang et al. | |
| D804,133 | S | 11/2017 | Yang et al. | |
| 2008/0041861 | A1 | 2/2008 | Crawford et al. | |
| 2009/0261105 | A1 | 10/2009 | Cunningham et al. | |
| 2010/0219192 | A1 * | 9/2010 | Quan | B65F 1/163 220/495.08 |
| 2011/0079598 | A1 | 4/2011 | Bally et al. | |
| 2016/0200508 | A1 | 7/2016 | Thoma et al. | |

* cited by examiner

CONTAINER WITH DIVERTER BAR

CROSS-REFERENCE TO RELATED APPLICATION

The present invention claims benefit of U.S. Provisional Patent Application Ser. No. 62/662,263, filed on Apr. 25, 2018, the entire disclosure of which is considered as part of this application and is hereby incorporated by reference.

BACKGROUND OF THE INVENTION

1. Field of the Invention

The present invention relates generally to a container.

2. Description of the Prior Art

Waste cans are well known. Generally, a waste can comprises an open-top can including a cover attached thereto, wherein the can is adapted to receive an open bag therein for receiving contents. The upper portion of the bag held within the can is often draped over the upper edge of the can, and the bag maintains its position within the can primarily by friction between the bag and the rim of the can. The bag may also be secured to the container by a ring that assembles to the rim and secures the bag with a clamping force. In order to secure a pair of bags to the rim of the can, typically the rim of the can defines a pair of notches for each bag to grip, thereby providing tension in the bags between the notches. However, the frictional engagement of the bag between the notches is generally inadequate to maintain tension as the bags receive contents. When contents contact the tension segments of the bags, the contents fall between the bags. Thus, a dividable waste can typically includes a diverter bar that releasably attaches to the wall.

One such waste can is shown in U.S. Pat. App. Publication No. 2010/0219192. The waste can includes a base and a wall disposed about and attached to the base. The wall defines a rim spaced from the base, as well as a compartment extending between the base and the wall. A lid having an inner surface and an outer surface is coupled to the wall for covering the compartment. A diverter bar has a body extending between body ends with the body releasably engaging the wall to secure the diverter bar to the wall and separate the compartment into at least two sections. However, the waste can lacks a retainer attaching to the lid for securing the diverter bar in a storage position.

SUMMARY OF THE INVENTION

The present invention provides for a container that stores a diverter bar onto the lid of the container, thereby providing ease of shipment and storage. In addition, the present invention allows the diverter bar to be maintained in a well-fitted position on the lid of the container. Further, the present invention provides for stacking several containers in a nested capacity for easily transporting and displaying bulk quantities of containers.

It is one aspect of the present invention to provide a container including a base and a wall disposed about and attached to the base. The wall defines a rim spaced from the base, as well as a compartment extending between the base and the wall. A lid having an inner surface and an outer surface is coupled to the wall for covering the compartment. The container has a diverter bar for separating the compartment into at least two sections in a first position. The diverter bar has a body extending between body ends, with the body releasably engaging the wall in the first position. A retainer is attached to the lid for receiving the diverter bar and securing the diverter bar to the lid to define a storage position.

It is another aspect of the present invention to provide a container including a base and a wall disposed about and attached to the base. The wall defines a rim spaced from the base, as well as a compartment extending between the base and the wall. A lid having an inner surface and an outer surface couples to the wall for covering the compartment. The container has a diverter bar for separating the compartment into at least two sections in a first position. The diverter bar has a body extending between body ends, with the body releasably engaging the wall in the first position. A retainer attaches to the lid for receiving the diverter bar and securing the diverter bar to the lid to define a storage position. A hook is attached to each of the body ends for engaging the wall, and a fortifying member extends outwardly from the body end to the hook connecting the body end to the hook.

BRIEF DESCRIPTION OF THE DRAWINGS

Other advantages of the present invention will be readily appreciated, as the same becomes better understood by reference to the following detailed description when considered in connection with the accompanying drawings pertaining to one embodiment of the container with diverter bar wherein.

DESCRIPTION OF THE ENABLING EMBODIMENT

Figure 1:
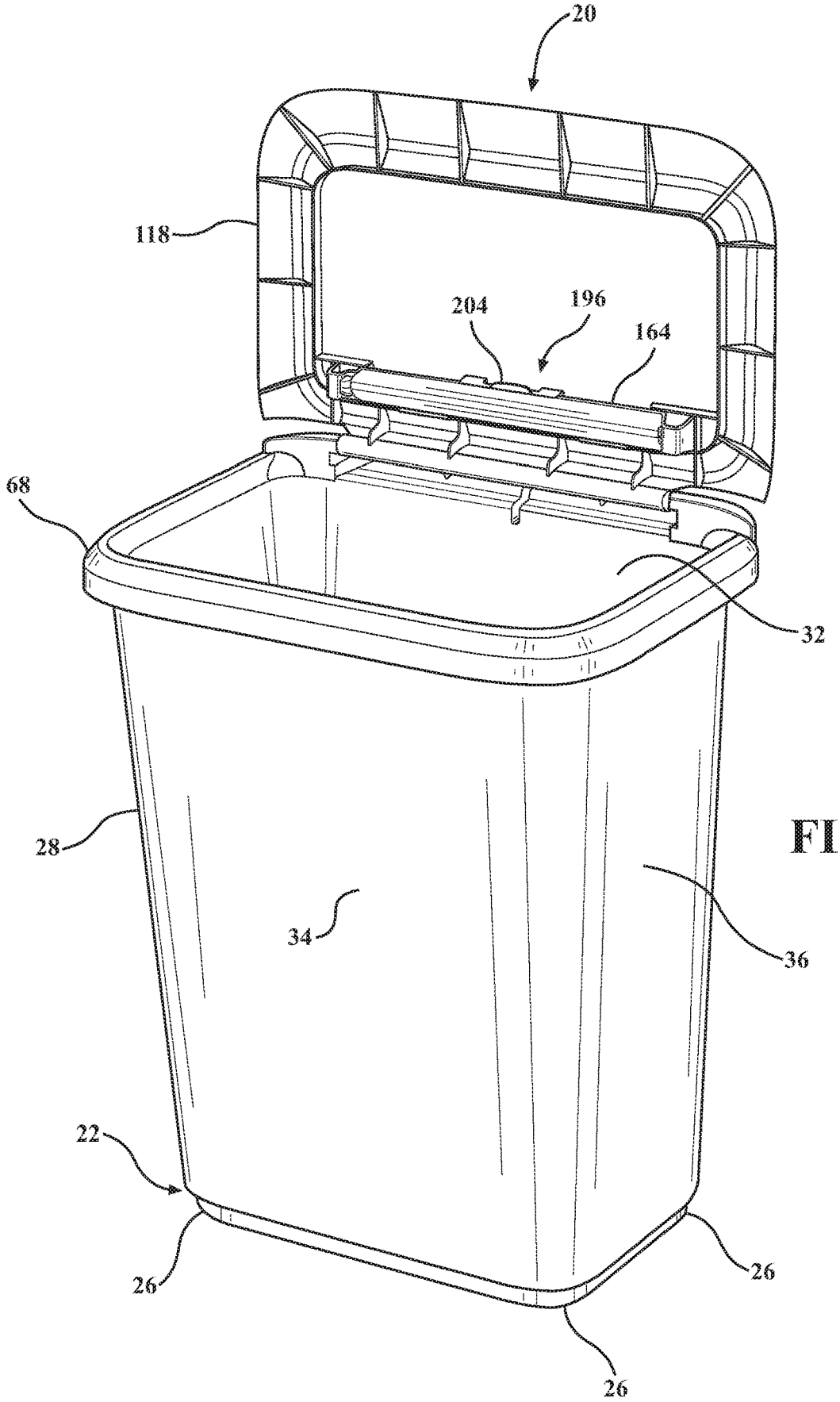
FIG. 1 is a perspective view of the container in accordance with one embodiment of the present invention with the diverter bar in the storage position.
Figure 2:
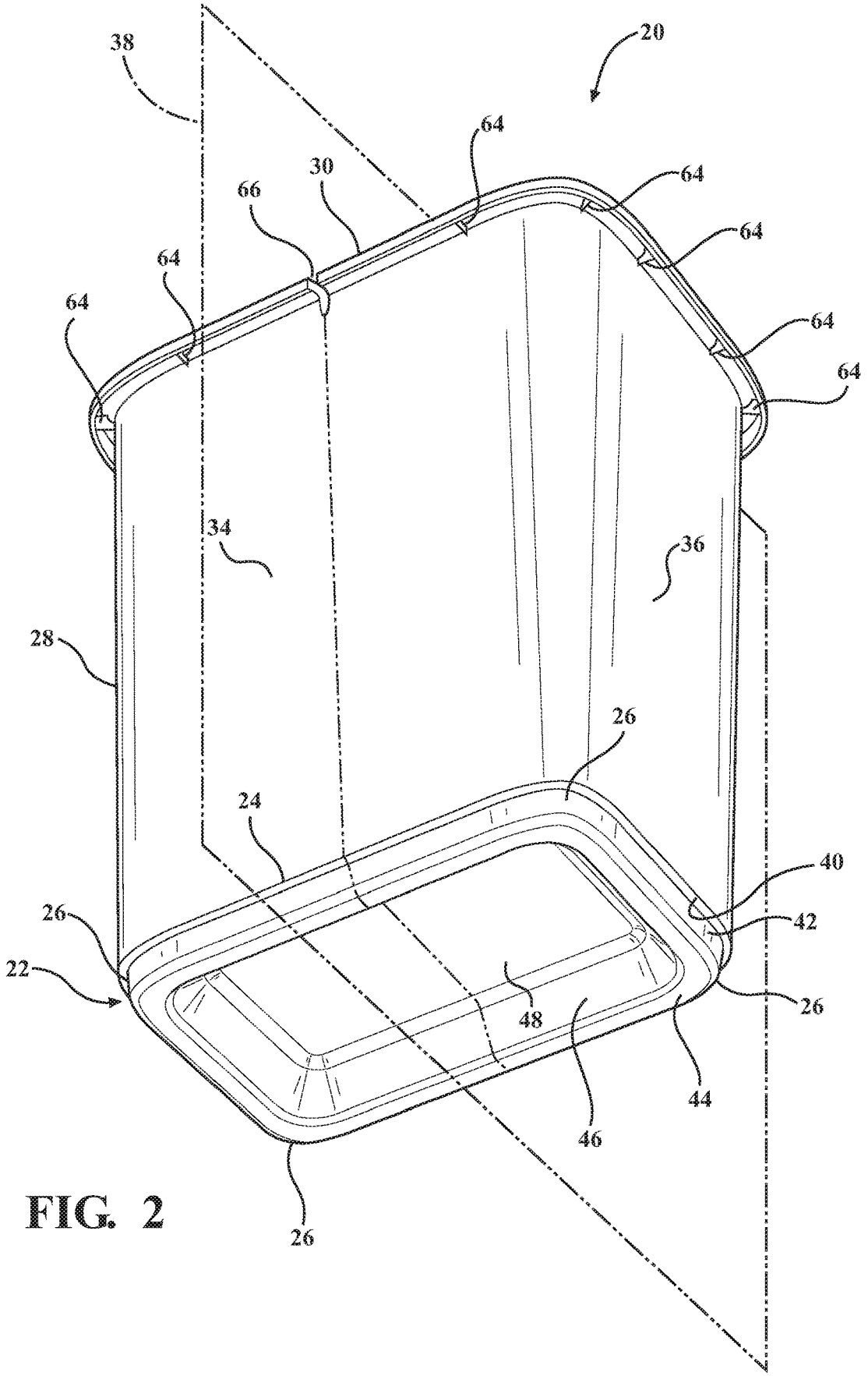
FIG. 2 is a perspective bottom view of the container.
Figure 3:
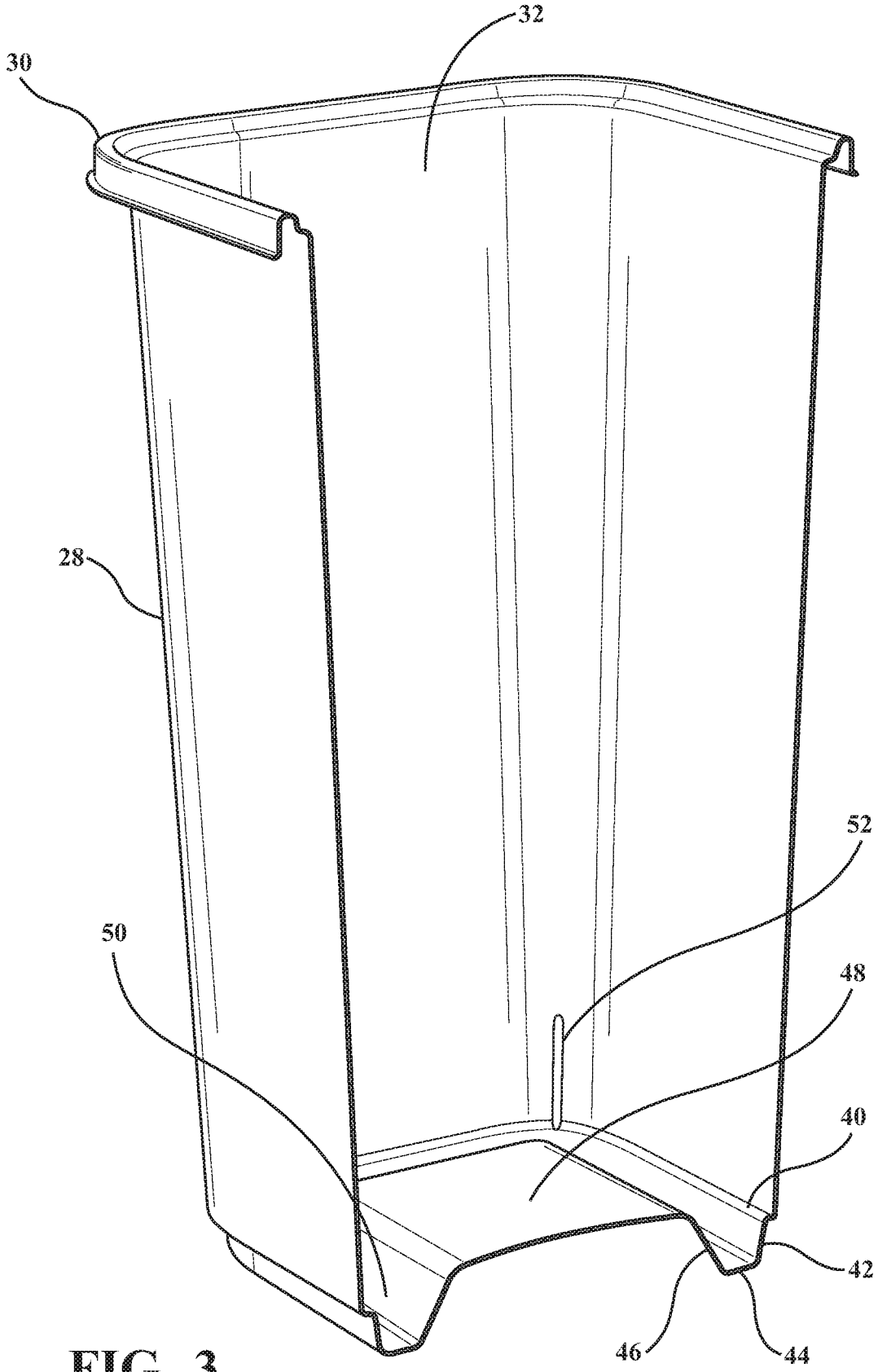
FIG. 3 is a cross-sectional view of the container.

Referring to the Figures, wherein like numerals indicate corresponding parts throughout the several views, a container 20, described in accordance with one embodiment of the present invention, is generally shown in FIG. 1. The container 20 can be used to hold a pair of bags or one large bag.

As best illustrated in FIGS. 1-4, the container 20 includes base 22 having a generally rectangular shape and defining a periphery 24 extending about the base 22 and presenting a plurality of four corners 26. The container 20 further includes a wall 28 extending outwardly from the periphery 24 of the base 22. The wall 28 defines a rim 30 spaced from the base 22. The base 22 and the wall 28 collectively define a compartment 32 extending therebetween.

The wall 28 includes a pair of center walls 34 and a pair of sidewalls 36. The center walls 34 are spaced from and opposed to one another, and the sidewalls 36 are also spaced from and opposed to one another. The center walls 34 and the sidewalls 36 connect to one another to form the wall 28 extending outwardly from the periphery 24 and continuously about the base 22. A plane 38 extends through the center walls 34 to divide the compartment 32 in two. According to one embodiment of the present invention, the plane 38 extends centrally through the center walls 34 and divides the center walls 34 in half.

A ledge 40 protrudes radially inward from the wall 28 into the compartment 32, and an outer band 42 extends downwardly from the ledge 40 and generally parallel with the wall 28. The base 22 includes a bottom 44 that extends radially inward from the outer band 42 and perpendicular to the wall 28. An inner band 46 extends upwardly from the bottom 44 at an oblique angle relative to the bottom 44 into the compartment 32 to form a platform 48 having a generally rectangular shape. In other words, the platform 48 is raised above the bottom 44 by the inner band 46 for supporting the bags and the contents in the bags. The bottom 44 and the bands 42, 46 define a groove 50 surrounding the platform 48. It should be appreciated that the groove 50 provides additional volume to the compartment 32, such that, when a large bag is used, the large bag fits into the groove 50 and allows the large bag to receive additional contents. The wall 28 also has a plurality of fins 52 extending outwardly from the ledge 40 into the compartment 32. The fins 52 allow for nesting and removing of a second container in the compartment 32 for easily transporting and displaying bulk quantities of containers 20.

The rim 30 has a generally U-shaped cross-section that protrudes radially outward from the walls 28. A rim ridge 54, a rim ramp 56, a rim brim 58, a rim side 60, and a rim sill 62 are interconnected to form the rim 30. The rim ridge 54 extends radially outward from and generally perpendicular to the wall 28, and the rim ramp 56 protrudes diagonally upward from the rim ridge 54. The rim brim 58 extends radially outward from the rim ramp 56 and generally parallel to the rim ridge 54. The rim side 60 extends downward and parallel with the wall 28 to the rim sill 62. The rim sill 62 is disposed below the rim ridge 54 and protrudes radially outward from and perpendicular to the rim side 60. A plurality of rim webs 64 interconnect the wall 28 and rim 30 to provide structural integrity to the rim 30.

The rim 30 defines a pair of notches 66 disposed in the plane 38 that extend into each center wall 34 for receiving the bags. In other words, the notches 66 are coplanar with one another to divide the rim 30 in half. For example, when two bags are used, each bag is pulled over half of the rim 30 and between the notches 66. This way, the bags are in tension along the plane 38 between the notches 66 with the remainder of the bags pulled around the rim 30.

Figure 4:
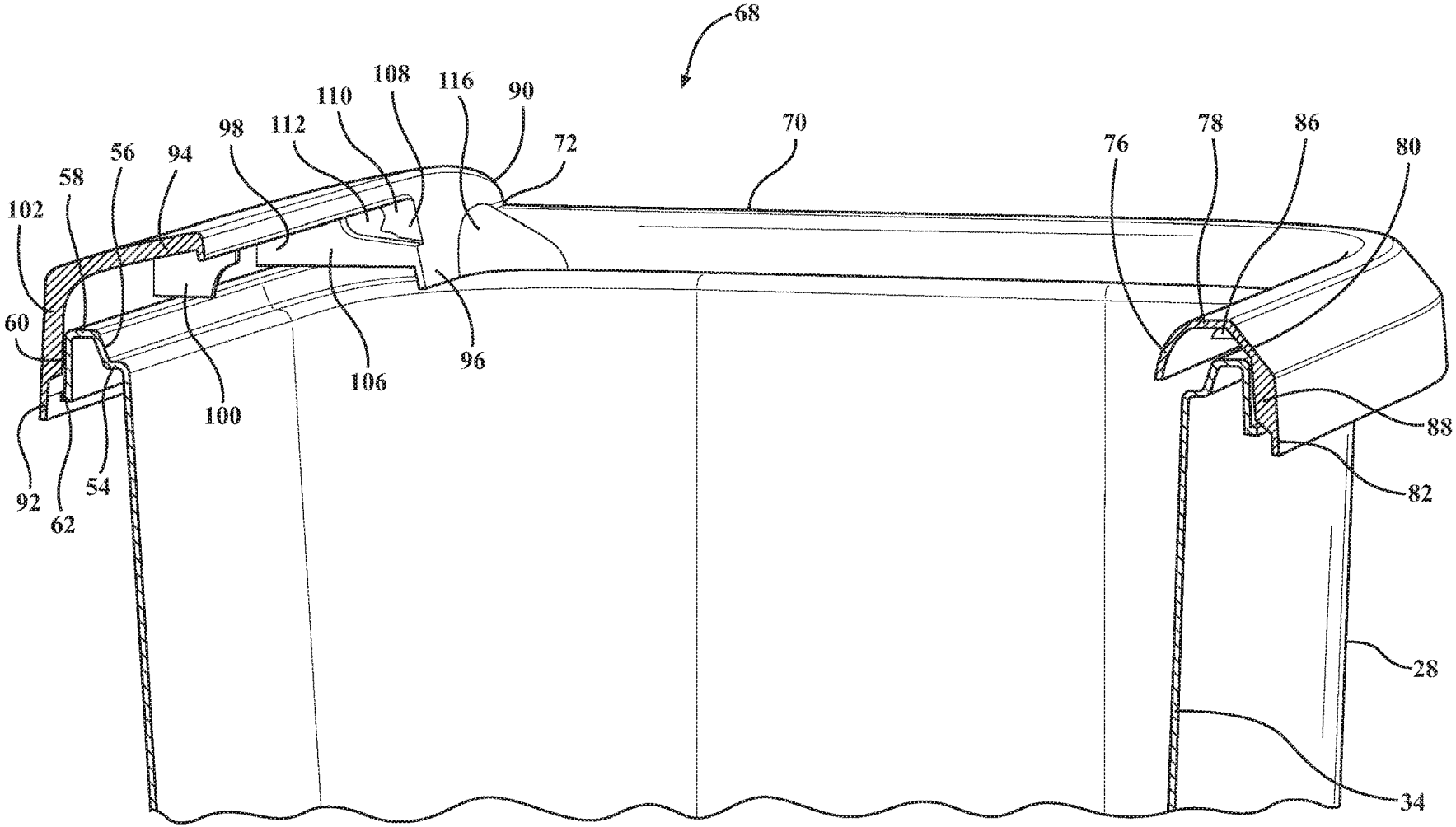
FIG. 4 is a fragmentary cross-sectional view of the container including the rim and the ring.
Figure 5:
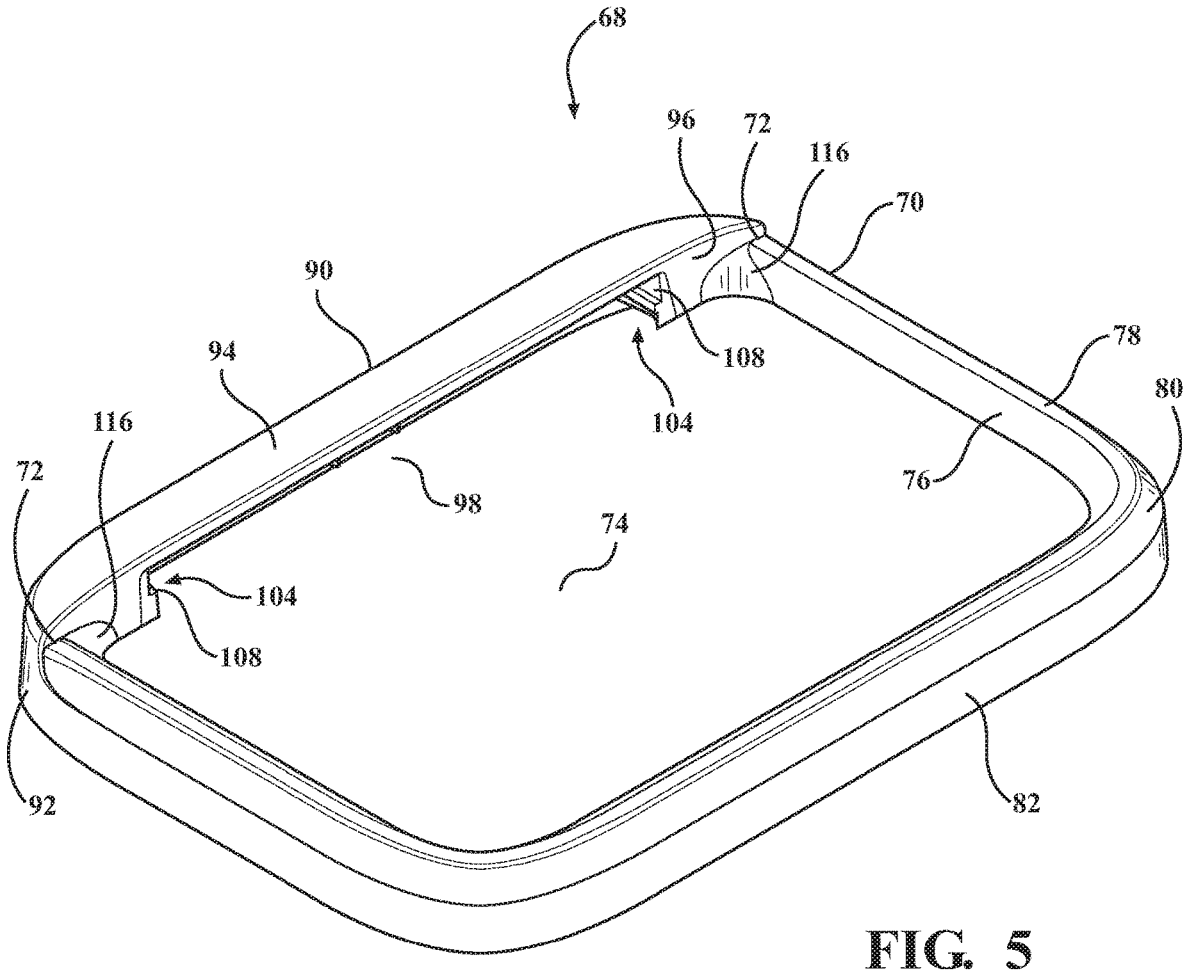
FIG. 5 is a perspective view of the ring.
Figure 6:
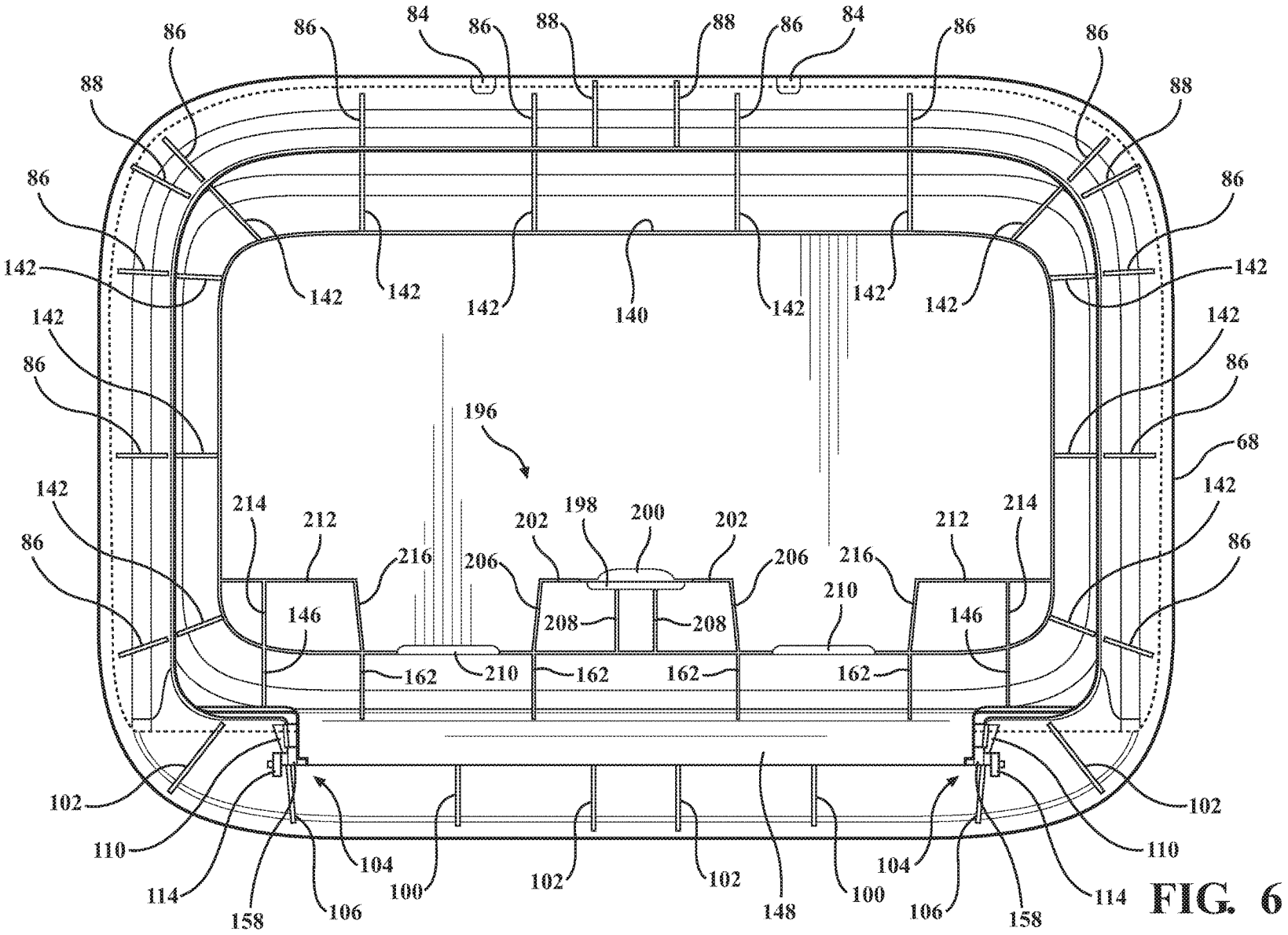
FIG. 6 is a bottom view of the lid and ring.

As best illustrated in FIGS. 4-6, the container 20 further includes a ring 68 having a generally rectangular shape that attaches to the rim 30. The ring 68 has a lower portion 70 having a U-shape that extends between a pair of lower portion ends 72 and covers one of the center walls 34 and both sidewalls 36, thereby forming an opening 74 above the compartment 32. A ring ramp 76, a ring brim 78, a ring slope 80, and a lower ring side 82 are interconnected to form a generally U-shaped cross-section of the rim 30. The ring ramp 76 has an arcuate shape and is spaced radially inward from the rim ramp 56. The ring ramp 76 extends radially outward from the opening 74 to the ring brim 78. The ring brim 78 extends radially outward from the ring ramp 76 and is spaced above the rim brim 58. The ring slope 80 extends diagonally downward from the ring brim 78 and beyond the rim sill 62. The lower ring side 82 extends parallel to the wall 28 and downward from the ring slope 80 below the rim sill 62 to conceal the remainder of the bags surrounding the rim 30 for aesthetic appeal.

A pair of latches 84 extends radially inward from the lower ring side 82 to engage the rim sill 62 and pinch the bags to the rim 30. A plurality of lower ring ribs 86 extends down from the ring brim 78, between the ring ramp 76 and the ring slope 80, and rests on the rim brim 58 to help hold the bags to the rim 30. Further, a plurality of lower clamps 88, each having an L-shape, extend radially inward from the lower ring side 82 toward the rim side 60. The lower clamps 88 squeeze the ring 68, the bags, and the rim 30 together.

The ring 68 also includes an upper portion 90 that has a generally U-shaped cross-section and spans between the lower portion ends 72 above one of the center walls 34. The upper portion 90 has an upper ring side 92 that is integrally formed with the lower ring side 82. The upper ring side 92 extends parallel with the wall 28 and below the rim sill 62 for concealing the bags. A top 94 extends upward and radially inward from the upper ring sides 92 between the lower portion ends 72. A ring face 96 extends downwardly from the top 94 and spans over the opening 74 to interconnect the lower portion ends 72. The ring face 96 also defines a slot 98 having a T-shape that extends toward the opening 74.

Similar to the lower portion 70 of the ring 68, the upper portion 90 of the ring 68 is secured to the rim 30 by a plurality of upper ring ribs 100 extending down from the top 94 and between the upper ring side 92 and the ring face 96. The upper ring ribs 100 rest on the rim brim 58 to sandwich the bags between the rim 30 and the upper ring ribs 100. Further, a plurality of upper clamps 102, each having an L-shape, extends radially inward from the upper ring side 92 toward the rim side 60 to squeeze the ring 68, the bags, and the rim 30 together.

Within the slot 98 is a pair of joints 104, spaced from and opposite one another. Each joint 104 has a joint rib 106 extending from the top 94 and connecting the upper ring side 92 to the ring face 96. Like the upper ring ribs 100, the joint ribs 106 rest on the rim brim 58 to help hold the bags. Moreover, each joint rib 106 defines a void 108 having a C-shape that extends from the slot 98. A flexible tab 110 extends cantilever from the ring face 96 into the void 108. The tab 110 and the joint rib 106 form a circular receptacle 112 spaced from the slot 98 that extends perpendicular to the tab 110. A pair of stops 114 extends parallel to the tabs 110 and the stops 114 is spaced apart by the tabs 110 and the slot 98. To interconnect the lower portion 70 and the upper portion 90 of the ring 68, a curb 116 bridges the lower portion ends 72 and the ring face 96.

Figure 7:
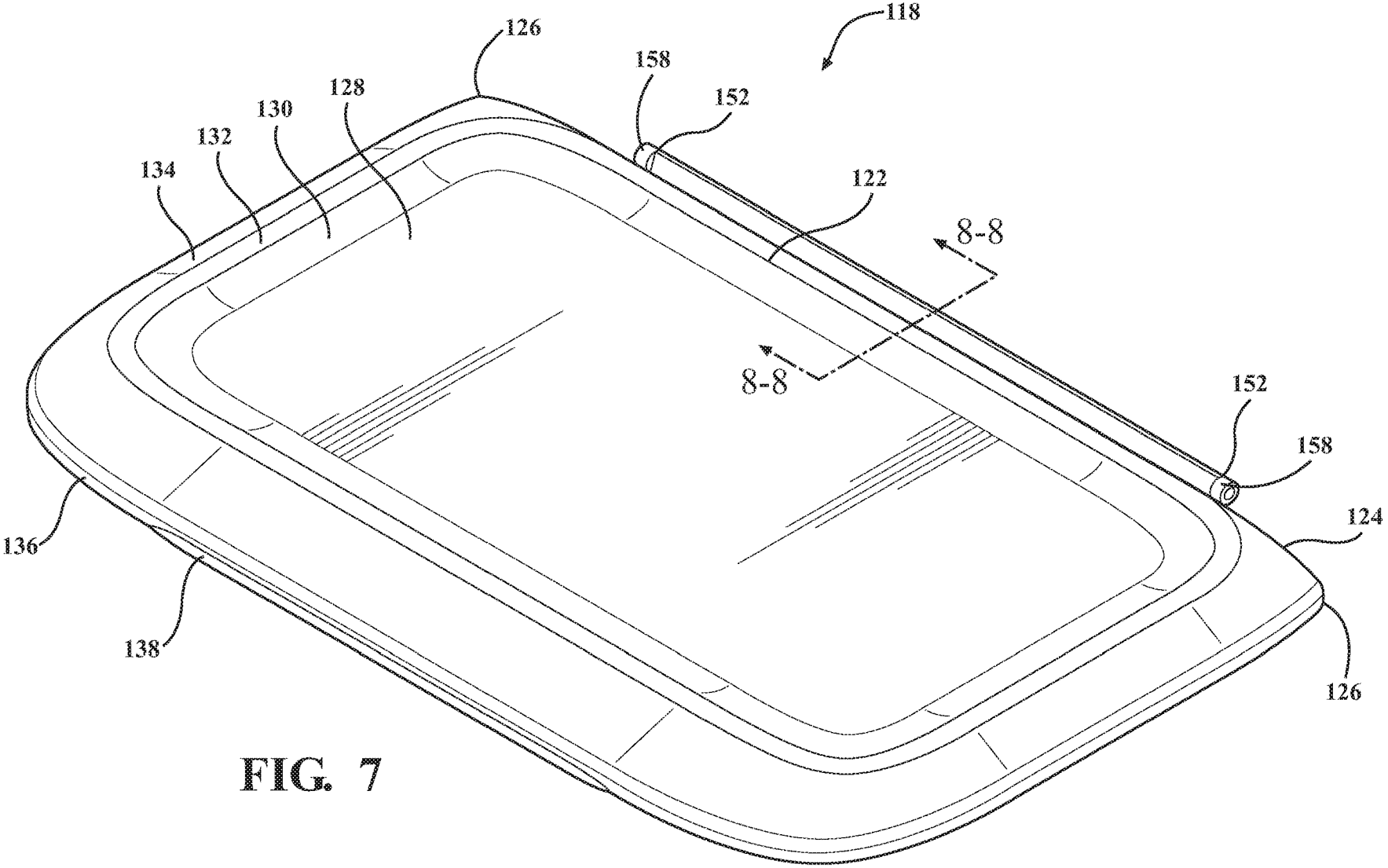
FIG. 7 is a perspective view of the lid.
Figure 8:
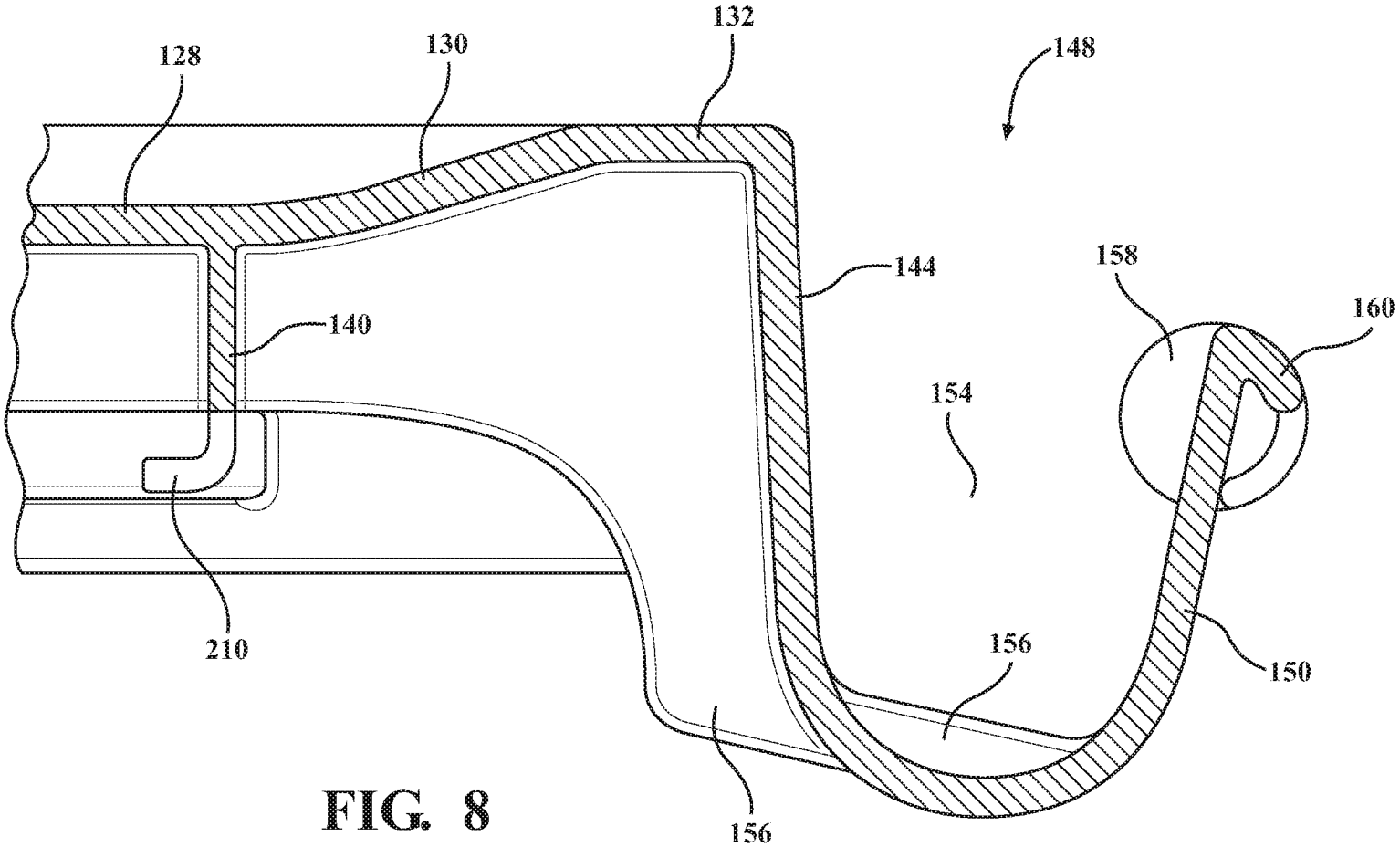
FIG. 8 is a cross-sectional view of the connection portion of the lid along the line 8-8 of FIG. 7.

As best illustrated in FIGS. 6-8, the container has a lid 118 having a generally rectangular shape that extends between an inner surface 120 and an outer surface 122. The lid 118 attaches to the ring 68 and includes a cover portion 124 having a rectangular-shape. The cover portion 124 extends between a pair of cover portion ends 126 and rests on the lower portion 70 of the ring 68 when the lid 118 is closed. A roof 128, having a rectangular shape, extends parallel to the opening 74 of the ring 68 for covering the opening 74.

The cover portion 124 of the lid 118 has a cross-section similar to the cross-section of the lower portion 70 of the ring 68. Specifically, a lid ramp 130, a lid brim 132, a lid slope 134, and a lid side 136 are interconnected and extend from the roof 128. The lid ramp 130 has an arcuate shape and extends diagonally upward from the roof 128. The lid brim 132 extends radially outward from the lid ramp 130 and is approximately level with the top 94 of the upper portion 90 of the ring 68. The lid slope 134 extends diagonally downward from the lid brim 132 toward the ring 68, and the lid side 136 protrudes downward from the lid slope 134 and generally parallel to the lower ring side 82. The cover portion 124 also has a handle 138 that extends radially outward from the cover portion 124 for receiving a lifting force to open and close the lid 118.

A loop 140 having an annular shape protrudes perpendicularly from the inner surface 120 of the lid 118 and surrounds the roof 128. A plurality of lid ribs 142 extend from the inner surface 120 of the lid 118. The lid ribs 142 interconnect the loop 140 and the lid side 136 and rest on the ring slope 80 when the lid 118 is closed. A lid face 144 having a rectangular shape extends perpendicularly from the roof 128 and joins the cover portion ends 126 together. When the lid 118 is closed, the lid face 144 is adjacent and parallel to the ring face 96. A pair of lid face ribs 146 extends from the inner surface 120 and interconnects the lid face 144 and the loop 140 to reinforce the lid face 144.

In addition to the cover portion 124, the lid 118 has a connection portion 148 which has a U-shaped cross-section. The connection portion 148 extends away from the lid face 144 toward the upper portion 90 of the ring 68 in the form of a flap 150 having an arcuate shape. The flap 150 extends between a pair of extremities 152 to define a channel 154. A plurality of lid webs 156 extends between the lid face 144 and the flap 150 in the channel 154 for supporting the connection portion 148. Additionally, when the lid 118 is opened, the lid webs 156 rest against the ring face 96.

A hinge 158 having an annular shape extends outwardly from each extremity 152. The hinges 158 are received by the receptacles 112 of the ring 68 for coupling the lid 118 to the ring 68. A curl 160 extends away from the flap 150 and along the flap 150 between the extremities 152 for supporting the hinges 158. A plurality of coupling ribs 162 extends between the connection portion 148 and the loop 140 for securing the connection portion 148 to the cover portion 124.

During assembly, a user may insert the connection portion 148 into the slot 98, such that the hinges 158 are in-line with the voids 108. As the hinges 158 are pushed into the voids 108, the flexible tabs 110 deflect outward until the hinges 158 are disposed within the receptacles 112. The tabs 110 then snap inwardly to pivotally couple the lid 118 to the ring 68. The hinges 158 contact the stops 114 to prevent the hinges 158 from moving axially, thereby preventing the lid 118 from moving side-to-side.

Figure 9:
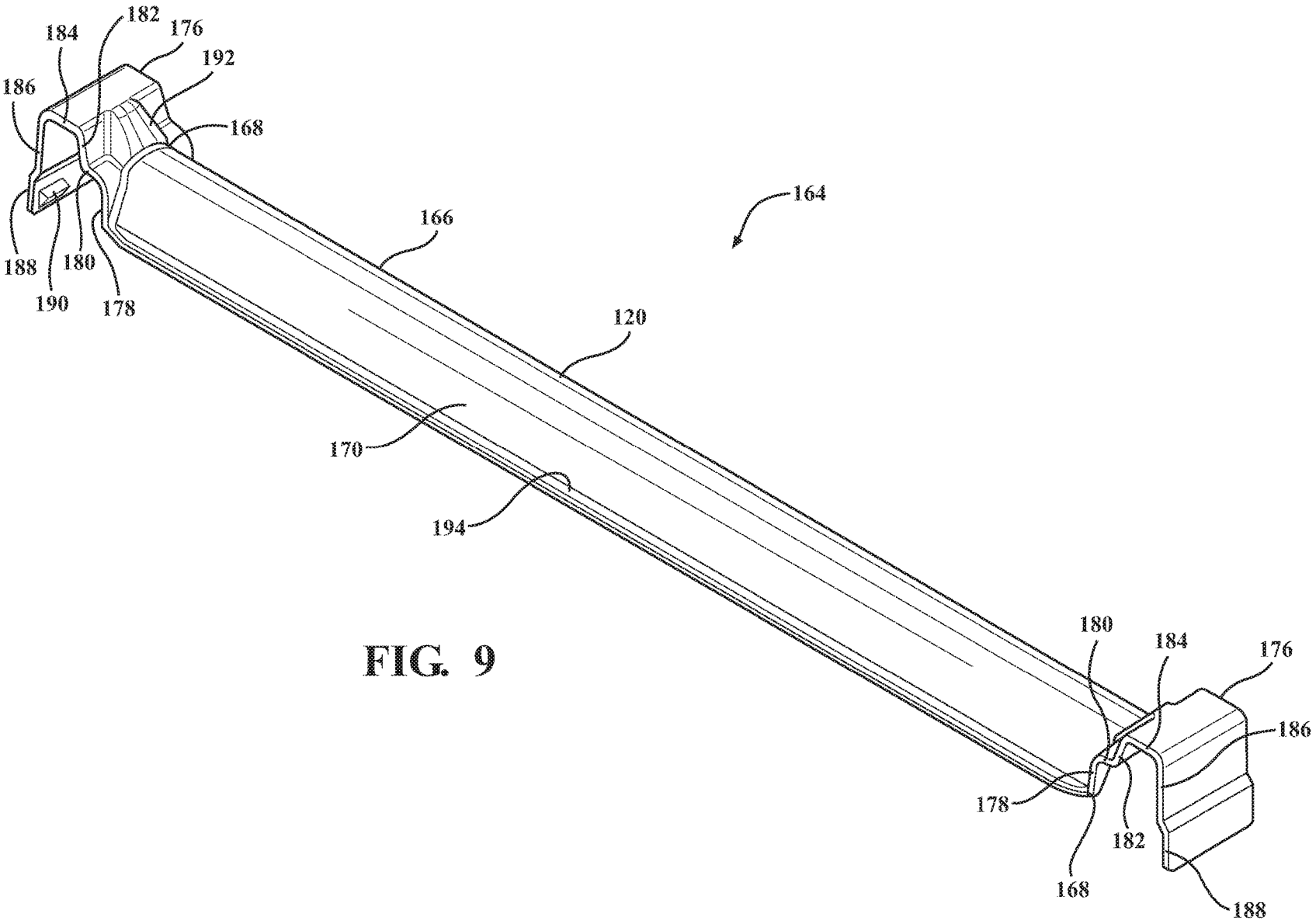
FIG. 9 is a perspective view of the diverter bar.
Figure 10:
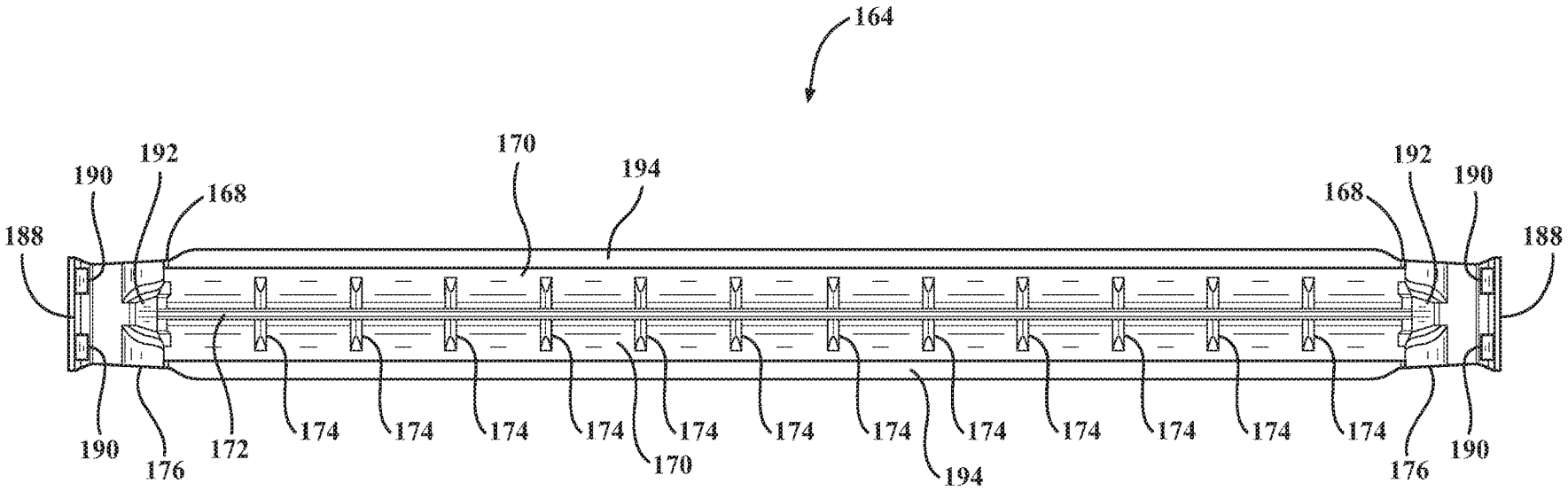
FIG. 10 is a bottom view of the diverter bar.
Figure 11:
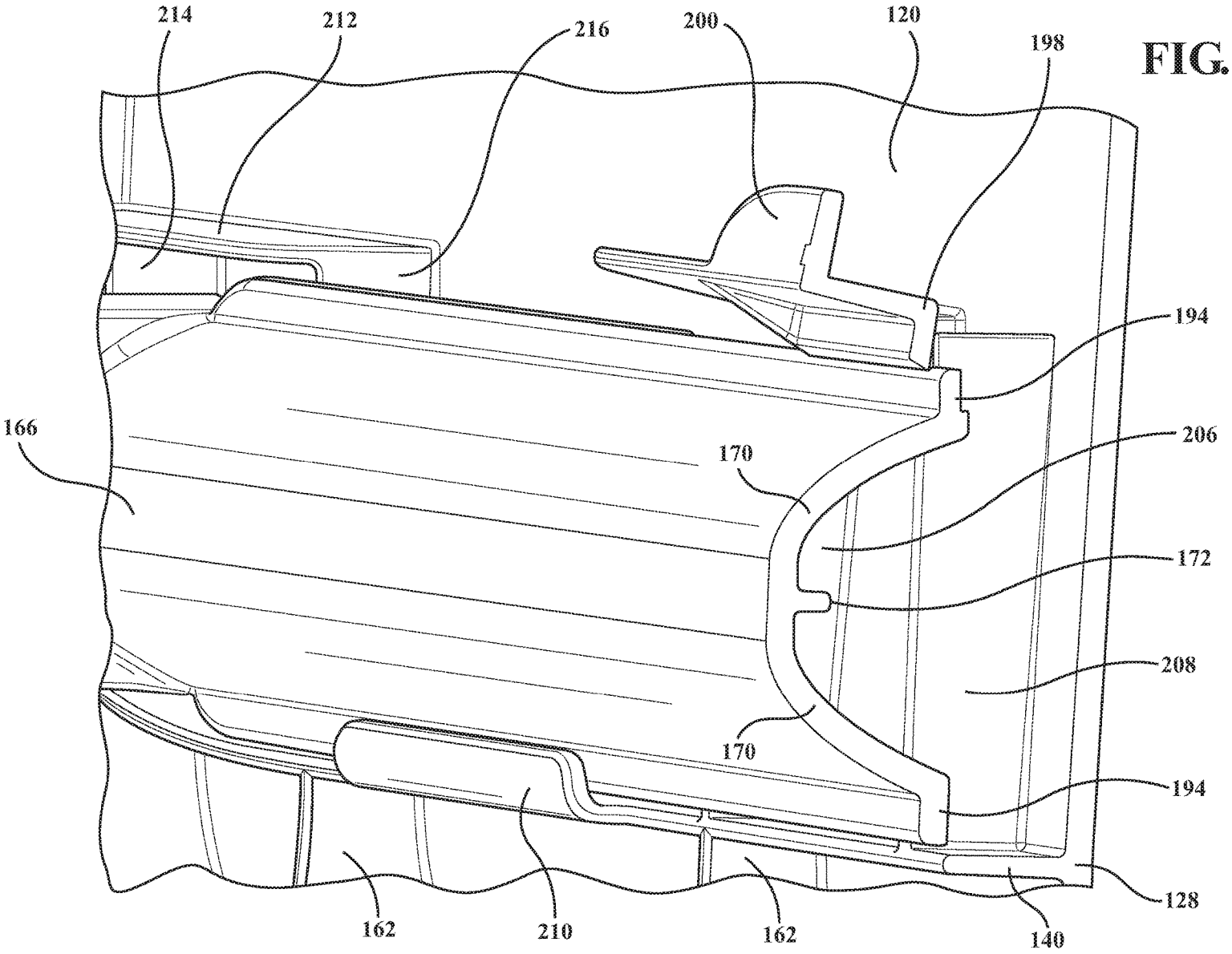
FIG. 11 is a fragmentary cross-sectional view of the retainer and diverter bar in the secured position.

As best illustrated in FIGS. 9-11, the container 20 further includes a diverter bar 164 for optional attachment to the rim 30. It should be appreciated that the diverter bar 164 can also be referred to as a divider 164. The diverter bar 164 has an elongate body 166 extending between body ends 168. The body 166 of the diverter bar 164 has a V-shaped cross-section with two outwardly-angled legs 170 for deflecting articles into one section of the compartment 32 or the other. When in use, the diverter bar 164 extends along the plane 38 for covering the tension segments and securing the bags to the rim 30. Further, the diverter bar 164 covers the notches 66 and prevents articles from falling between the bags.

The diverter bar 164 also has a spine 172 extending between the legs 170 and between the body ends 168. A plurality of diverter bar ribs 174 extends between the legs 170 and interconnects the legs 170 and the spine 172. The diverter bar ribs 174 and spine 172 provide reinforcement to the body 166 of the diverter bar 164.

In order to secure the diverter bar 164 to the rim 30, a hook 176 having a U-shaped cross-section extends outwardly from each body end 168 of the diverter bar 164. The shape of the hook 176 contours to the cross-section of the rim 30, such that the diverter bar 164 reinforces the rim 30. In particular, each one of the hooks 176 includes an edge 178 extending generally perpendicular to the body 166 for engaging the wall 28. A hook ridge 180 extends outwardly from and perpendicular to the edge 178 for engaging the rim ridge 54. A hook ramp 182 extends diagonally outward from the hook ridge 180 for engaging the rim ramp 56. A hook brim 184 extends outwardly from the hook ramp 182 and perpendicular to the edge 178 for engaging the rim brim 58. A hook side 186 extends downward from the hook brim 184 and parallel to the edge 178 for engaging the rim side 60. Further, a hook sill 188 extends outwardly from the hook side 186 for engaging the rim sill 62 and extending below the rim sill 62.

The hooks 176 present a pair of clasps 190 that extends from each hook sill 188 toward the hook brim 184 to secure the diverter bar 164 to the rim 30 and prevent the diverter bar 164 from lifting off the rim 30. The clasps 190 have a wedge shape and engage the rim 30 underneath the rim sill 62. The clasps 190 are spaced from one another on the hook sill 188, such that when the diverter bar 164 is disposed over the bags and the notches 66, one clasp 190 of each hook 176 engages one of the bags while the other clasp 190 engages the other bag.

A fortifying member 192 having a semi-conical shape extends outwardly from each body end 168 to the hook ridges 180 and the hook ramps 182 to provide reinforcement to the hook 176. The fortifying member 192 thereby increases the strength of the hooks 176 and improves the lifespan of the diverter bar 164. In addition, the shape of the fortifying members 192 provides for a smooth surface transition between the body 166 and the hooks 176 for aesthetic appeal when the lid 118 is open. The diverter bar 164 also includes a lip 194 extending radially outward from and perpendicular to each of the legs 170 and between the body ends 168.

As best illustrated in FIGS. 1, 6, and 11, the container 20 includes a retainer 196 extending outwardly from the inner surface 120 of the lid 118. The retainer 196 is adapted to secure the diverter bar 164 to define a storage position. As best shown in FIGS. 6 and 11, the retainer 196 includes a lock 198 having a wedge-shaped cross-section. The lock 198 extends perpendicularly to the inner surface 120 of the lid 118 to receive one of the lips 194 and clutch the lip 194 in the storage position. A flange 200 extends outwardly from the lock 198 and parallel to the lid 118. To open the lock 198 and release or receive the diverter bar 164, a user may push on the flange 200 to flex the lock 198 toward the lid 118. As best shown in FIG. 1, a pair of linkages 202, spaced from one another, extends from the inner surface 120 of the lid 118 and defines a gap 204. Due to the gap 204, the lock 198 is not endlessly connected to the lid 118 and therefore has additional flexibility.

A plurality of lock slats 206 extends outwardly from the inner surface 120 of the lid 118 and between the loop 140 and the linkages 202. The retainer 196 also has a pair of retainer ribs 208 that extends between the loop 140 and the gap 204 for supporting the lip 194 in the storage position. The lock slats 206 and the retainer ribs 208 engage the lip 194 in the storage position to prevent any movement of the diverter bar 164 between the retainer 196 and the lid 118. Further, the retainer 196 includes a pair brackets 210 spaced from one another and extending parallel to the lid 118 and have an L-shaped cross-section. While the lock 198 secures one lip 194 of the diverter bar 164, the brackets 210 receive the other lip 194 for additional security of the diverter bar 164 in the storage position.

The retainer 196 also includes a pair of barriers 212 spaced from and opposite one another. Each of the barriers 212 extends from the inner surface 120 of the lid 118 and extends from the loop 140 toward the lock 198 for reinforcing the retainer 196. A pair of braces 214, spaced from one another, extends outwardly from the inner surface 120 of the lid 118 between the barriers 212 and the loop 140. In the storage position, the hook sills 188 are abutting the braces 214, such that the braces 214 sandwich the diverter bar 164. The retainer 196 also has a pair of barrier slats 216 spaced from one another and between the braces 214. The barrier slats 216 extend outwardly from the inner surface 120 of the lid 118 and between the loop 140 and each barrier 212. Like the lock slats 206 and the retainer ribs 208, the barrier slats 216 engage the lip 194 in the storage position to prevent any movement of the diverter bar 164 between the retainer 196 and the lid 118.

Obviously, many modifications and variations of the present invention are possible in light of the above teachings and may be practiced otherwise than as specifically described while within the scope of the present disclosure. It is contemplated that all features described and of all embodiments can be combined with each other, so long as such combinations would not contradict one another.

What is claimed is:

1. A container comprising:

a base;

a wall disposed about and attached to said base defining a rim spaced from said base and a compartment extending between said base and said wall;

a lid having an inner surface and an outer surface coupled to said wall for covering said compartment;

a diverter bar having a body extending between body ends with said body releasably engaging said wall to secure said diverter bar to said wall to define a first position separating said compartment into at least two sections;

said body of said diverter bar having a spine extending between said body ends;

said body including legs extending outwardly relative to said spine;

said diverter bar including a pair of lips opposite one another and extending radially outward from each of said legs and between said body ends;

a retainer attached to said lid for receiving said diverter bar and securing said diverter bar to said lid to define a storage position;

said retainer including a lock extending outward from said inner surface of said lid to receive said lips of said diverter bar and clutch said lips in said storage position;

said lock including a pair of linkages spaced from one another and extending from said inner surface of said lid to define a gap for providing flexibility to said lock; and said retainer including a plurality of lock slats extending outwardly from said inner surface of said lid and between said linkages for supporting said lips in said storage position.

2. The container as set forth in claim 1 further including a flange extending outwardly from said lock and parallel to said lid to allow said lock to flex in response to an opening force applied to said lock.

3. The container as set forth in claim 1 further including a hook attached to each of said body ends for engaging said wall; and a fortifying member extending outwardly from said body end to said hook connecting said body end to said hook.

4. The container as set forth in claim 3 wherein said hook includes at least one clasp extending outwardly from said hook and toward said body for engaging said wall in said first position to secure said diverter bar to said wall.

5. The container as set forth in claim 3 wherein said retainer includes a pair of braces, spaced from one another, extending outwardly from said inner surface of said lid for receiving said hook and sandwiching said hook and said diverter bar between said braces in said storage position.

6. A container comprising:

a base;

a wall disposed about and attached to said base defining a rim spaced from said base and a compartment extending between said base and said wall;

said rim including a rim ridge extending radially outward from said wall;

said rim including a rim ramp spaced radially outward from said wall and extending outwardly at an oblique angle from said rim ridge;

said rim including a rim brim spaced radially outward from said rim ridge and extending radially outward from said rim ramp;

said rim including a rim side spaced radially outward from said rim ramp and extending outwardly from said rim brim and generally parallel to said wall;

said rim including a rim sill extending radially outward from said rim side and disposed below said rim ridge;

a lid having an inner surface and an outer surface coupled to said wall for covering said compartment;

a diverter bar having a body extending between body ends with said body releasably engaging said wall to secure said diverter bar to said wall to define a first position separating said compartment into at least two sections;

a retainer attached to said lid for receiving said diverter bar and securing said diverter bar to said lid to define a storage position;

a hook attached to each of said body ends for engaging said wall;

each one of said hooks including an edge extending generally perpendicular to said body for engaging said wall;

each one of said hooks including a hook ridge extending outwardly from and perpendicular to said edge for engaging said rim ridge;

each one of said hooks including a hook ramp extending outwardly at an oblique angle from said hook ridge for engaging said rim ramp;

each one of said hooks including a hook brim extending outwardly from said hook ramp and perpendicular to said edge for engaging said rim brim;

each one of said hooks including a hook side extending outwardly from said hook brim and parallel to said edge for engaging said rim side;

each one of said hooks including a hook sill extending outwardly from said hook side for engaging said rim sill;

a fortifying member having a semi-conical shape and extending outwardly from said body end to said hook connecting said body end to said hook; and each of said hooks including at least one clasp extending outwardly from said hook sill toward said hook brim for engaging said rim sill to secure said diverter bar to said rim and to secure the bags to said rim in said first position.

7. The container as set forth in claim 6 wherein said diverter bar includes at least one lip extending outwardly from said body whereby said at least one lip engages said retainer in response to said diverter bar being in said storage position.

8. The container as set forth in claim 7 wherein said at least one lip includes a pair of lips extending radially outward from said body opposite one another and between said body ends.

9. The container as set forth in claim 7 further including a lock extending outwardly from said inner surface of said lid to receive said at least one lip and clutch said lip in said storage position.

10. The container as set forth in claim 9 further including a flange extending outwardly from said lock and parallel to said lid to allow said lock to flex in response to an opening force applied to said lock.

11. The container as set forth in claim 6 wherein said retainer includes a pair of braces, spaced from one another, extending outwardly from said inner surface of said lid for receiving said hook and sandwiching said hook and said diverter bar between said braces in said storage position.

12. A container comprising:

a base of a generally rectangular shape having a periphery extending about said base and defining a plurality of four corners;

a wall extending outwardly from said periphery of said base defining a rim spaced from said base and a compartment extending between said base and said wall;

said wall including a pair of center walls spaced from and opposite to one another and a pair of sidewalls spaced from and opposite to one another connected to said center walls;

said compartment being divided by a plane extending centrally through said center walls;

said periphery of said base including a ledge extending radially inward from said wall into said compartment and an outer band extending outwardly from said ledge;

said base including a bottom extending radially inward from said outer band and perpendicular to said wall and an inner band extending outwardly from said bottom at an oblique angle into said compartment to define a platform having a generally rectangular shape disposed in said compartment and extending radially inward from said inner band;

said bottom and said bands defining a groove surrounding said platform for supporting articles in the bags disposed on said platform;

said wall having a plurality of fins extending outwardly from said ledge into said compartment for supporting a second container;

said rim including a rim ridge extending radially outward from said wall;

said rim including a rim ramp spaced radially outward from said wall and extending outwardly at an oblique angle from said rim ridge;

said rim including a rim brim spaced radially outward from said rim ridge and extending radially outward from said rim ramp;

said rim including a rim side spaced radially outward from said rim ramp and extending outwardly from said rim brim and generally parallel to said wall;

said rim including a rim sill extending radially outward from said rim side and disposed below said rim ridge;

said rim including a plurality of rim webs connected to said wall and said rim side for supporting said rim;

said rim defining a pair of notches disposed in said plane and opposite one another and extending from said rim into said center walls for receiving tension segments of two bags in tension between said notches with the remainder of the bags disposed about said rim;

a ring having a generally rectangular shape for attachment to said rim;

said ring having a U-shaped lower portion and a generally U-shaped cross-section and extending between a pair of lower portion ends to define an opening;

said lower portion including a ring ramp having an arcuate shape spaced radially inward from said rim ramp and extending outwardly from said opening;

said lower portion having a ring brim extending radially outward from said ring ramp and spaced above said rim brim;

said lower portion including a ring slope extending radially outward at an oblique angle from said ring brim toward said rim;

said lower portion including a lower ring side and extending outwardly from said ring slope for concealing the bags;

said lower portion including a plurality of latches extending from said lower ring side toward said rim to engage said rim sill for securing the bags to said rim;

said lower portion including a plurality of lower ring ribs extending outwardly from said ring brim and between said ring ramp and said ring slope for disposition on said rim brim;

said lower portion including a plurality of lower clamps each having an L-shape extending from said lower ring side toward said ring ramp to engage said rim side and said rim sill for supporting the bags;

said ring having an upper portion having a generally U-shaped cross-section and extending between said lower portion ends;

said upper portion having an upper ring side connected to said lower ring side and spaced radially outward from said rim side for concealing the bags;

said upper portion having a top extending from said upper ring sides between said lower portion ends;

said upper portion having a ring face interconnecting said lower portion ends and extending between said top and said opening to define slot having a T-shape;

said upper portion including a plurality of upper ring ribs extending outwardly from said top and between said upper ring side and said ring face for disposition on said rim brim;

said upper portion including a plurality of upper clamps each having an L-shape extending from said upper ring side toward said ring ramp to engage said rim side and said rim sill for supporting the bags;

said upper portion including a pair of joints, spaced from and opposite one another, disposed adjacent said slot each having a joint rib extending outwardly from said top and between said upper ring side and said ring face for disposition on said rim brim and defining a void having a C-shape;

each of said joints having a flexible tab extending cantilever from said ring face into said void to define a circular receptacle extending perpendicular to said tab and said joint rib;

said ring including a pair of stops, spaced from and opposite one another, extending generally parallel to said joint ribs and extending outwardly from said top toward said rim;

said ring including a curb interconnecting said lower portion ends and said ring face to couple said lower portion to said upper portion;

a lid having a generally rectangular shape extending between an inner surface and an outer surface for attachment to said ring;

said lid including a cover portion having a generally rectangular shape and extending between a pair of cover portion ends for disposition adjacent said lower portion;

said cover portion including a roof having a rectangular shape extending generally parallel to said opening for covering said opening;

said cover portion including a lid ramp having an arcuate shape extending at an oblique angle from said roof and spaced from said ring ramp;

said cover portion having a lid brim extending radially outward from said lid ramp and spaced from said ring brim;

said cover portion having a lid slope extending radially outward at an oblique angle from said lid brim toward said ring;

said cover portion having a lid side extending outward from said lid slope and generally parallel to said lower ring side;

said cover portion having a handle extending outward and generally perpendicular to said lid side for receiving a lifting force to open and close said lid;

said cover portion including a loop having an annular shape extending outwardly from and perpendicular to said inner surface toward said opening;

said cover portion including a plurality of lid ribs extending from said inner surface of said lid and between said loop and said lid side for disposition on said ring slope;

said cover portion including a lid face having a rectangular shape interconnecting said cover portion ends and extending perpendicular to said roof from said lid brim and said lid slope toward said opening;

said cover portion including a pair of lid face ribs extending from said inner surface and between said lid face and said loop for supporting said cover portion;

said lid including a connection portion having a U-shaped cross-section and extending outwardly from said lid face toward said upper portion for connection to said ring;

said connection portion including a flap having an arcuate shape extending between a pair of extremities to define a channel;

said connection portion having a plurality of lid webs extending between said lid face and said flap in said channel for supporting said connection portion;

said connection portion including a hinge having an annular shape extending outwardly from each of said extremities, whereby said hinges are received by said receptacles for pivotally coupling said lid to said ring;

said connection portion including a curl extending away from said flap and along said flap between said extremities for supporting said hinges;

said lid including a plurality of coupling ribs extending between said connection portion and said loop for securing said connection portion to said cover portion;

a diverter bar having a body extending between body ends for attachment to said rim and extending along said plane for covering the tension segments and securing the bags to said rim to define a first position;

said body having a V-shaped cross-section with two outwardly-angled legs;

said diverter bar having a spine extending between said legs and extending outwardly from said diverter bar between said body ends;

said diverter bar having a plurality of diverter bar ribs extending between said legs and interconnecting said legs and said spine;

said diverter bar including a hook having a U-shaped cross-section extending outwardly from said body ends for engaging said rim to cover the tension segments of the bags along said plane;

each one of said hooks including an edge extending generally perpendicular to said body for engaging said wall;

each one of said hooks including a hook ridge extending outwardly from and perpendicular to said edge for engaging said rim ridge;

each one of said hooks including a hook ramp extending outwardly at an oblique angle from said hook ridge for engaging said rim ramp;

each one of said hooks including a hook brim extending outwardly from said hook ramp and perpendicular to said edge for engaging said rim brim;

each one of said hooks including a hook side extending outwardly from said hook brim and parallel to said edge for engaging said rim side;

each one of said hooks including a hook sill extending outwardly from said hook side for engaging said rim sill;

a retainer extending outwardly from said inner surface of said lid for securing said diverter bar to said lid to define a storage position;

said diverter bar including at least one lip extending outwardly from said body whereby said at least one lip engages said retainer in response to said diverter bar being in said storage position;

said at least one lip including a pair of lips opposite one another and extending radially outward from and perpendicular to each of said legs and between said body ends;

said diverter bar including a fortifying member having a semi-conical shape extending outwardly from said body end to hook ridge and said hook ramp for supporting said hook;

each of said hooks including at least one clasp having a wedge shape extending outwardly from said hook sill toward said hook brim for engaging said rim sill to secure said diverter bar to said rim and to secure the bags to said rim in said first position;

said at least one clasp including a first clasp and a second clasp spaced from one another on said hook sill wherein said first clasp engages one bag and said second clasp engages the other bag in said first position;

said retainer including a lock having a wedge-shaped cross-section and extending outwardly from said inner surface of said lid to receive said at least one lip and clutch said lip in said storage position;

said lock including a flange extending outwardly from said lock and parallel to said lid to allow said lock to flex in response to an opening force applied to said lock;

said lock including having a pair of linkages spaced from one another and extending from said inner surface of said lid to define a gap for providing additional flexibility to said lock;

said retainer including a plurality of lock slats extending outwardly from said inner surface of said lid and between said loop and said linkages for supporting said lip in said storage position;

said retainer including a pair of retainer ribs extending outwardly from said inner surface of said lid and between said loop and said gap for supporting said lip in said storage position;

said retainer including a pair brackets spaced from one another each having an L-shaped cross-section and extending outwardly from said loop and parallel to said lid for receiving said at least one lip;

said retainer including a pair of barriers spaced from and opposite one another each extending from said inner surface of said lid and extending from said loop toward said lock;

said retainer including a pair of braces, spaced from one another, extending outwardly from said inner surface of said lid and extending from each of said barriers to said loop for receiving said hook sill and sandwiching said diverter bar between said braces in said storage position; and said retainer including a pair of barrier slats, spaced from one another and between said braces, extending outwardly from said inner surface of said lid and extending from each of said barriers to said loop for supporting said lip in said storage position.

* * * * *